US006425185B1

(12) United States Patent
Regnault et al.

(10) Patent No.: US 6,425,185 B1
(45) Date of Patent: Jul. 30, 2002

(54) MACHINE FOR REPRODUCING WRITING

(75) Inventors: Jean-Jacques Regnault, Bussy Saint Martin; Jean-Paul Regnault, Jossigny, both of (FR)

(73) Assignee: Signascript (FR)

( * ) Notice: Subject to any disclaimer, the term of this patent is extended or adjusted under 35 U.S.C. 154(b) by 0 days.

(21) Appl. No.: 09/558,140

(22) Filed: Apr. 21, 2000

(30) Foreign Application Priority Data

Apr. 23, 1999 (FR) ..... 99 05183

(51) Int. Cl.[7] ..... B43L 13/00; B43L 13/10

(52) U.S. Cl. ..... 33/18.2; 33/23.01; 33/25.1

(58) Field of Search ..... 33/18.1, 18.2, 33/20.1, 20.2, 20.4, 23.01, 23.04, 23.1, 25.1, 23.03, 25.2, 25.5, 18.3, 1 K; 702/150, 151, 152, 153, 154, 167, 168

(56) References Cited

U.S. PATENT DOCUMENTS 2,332,511 A 10/1943 Glassman et al. ..... 33/18
2,881,521 A 4/1959 Pearson ..... 33/25
4,306,464 A * 12/1981 Mosher ..... 33/18.2
5,009,013 A * 4/1991 Wiklund ..... 33/25.1
5,093,672 A * 3/1992 Gascuel et al. ..... 33/18.1
5,383,277 A * 1/1995 Shimoda et al. ..... 33/18.1

FOREIGN PATENT DOCUMENTS

FR 2 420 437 10/1979
GB 2 094 998 9/1982

* cited by examiner

*Primary Examiner*—Diego Gutierrez
*Assistant Examiner*—Madeline Gonzalez
(74) *Attorney, Agent, or Firm*—Dick and Harris

(57) ABSTRACT

A machine reproduces writing, in particular a signature, using a pantograph carrying a fountain pen or the like. Two branches of the pantograph have respective operating shafts coupled to respective rotational drive means including electric motors.

16 Claims, 2 Drawing Sheets

MACHINE FOR REPRODUCING WRITING

BACKGROUND OF THE INVENTION

1. Field of the Invention

The invention relates to a machine for reproducing writing intended to personalize automated mail by reproducing with a fountain pen, for example, signatures, flourishes and even salutations.

The invention relates more particularly to a pantograph-type machine for reproducing writing and is directed to improving the pantograph control system.

2. Description of the Prior Art

Various pantograph-type machines for reproducing writing are known in the art. A system of this kind is generally considered to be better for this purpose than an X-Y plotter, which is relatively slow at reproducing irregular curves such as those encountered in handwriting and/or a signature.

In the field of machines of this type, French patent No. 78 08626 describes a two-branch pantograph in which each branch has two elements articulated end-to-end and joined together at an articulation near which is attached the writing device, which can be a fountain pen. The mechanism is fitted with feelers for following the edges of an endless flexible belt which constitutes a kind of control cam for executing signatures. The movement of the belt conditions the displacement of each feeler and consequently each branch of the pantograph.

In other systems known in the art, the endless tape is replaced by a wooden disk whose contour is shaped to control the movements of the two branches of the pantograph and consequently of the fountain pen.

The belt or the disk, or more generally the member constituting the control cam, is of course representative of a given signature. The production of a component of this kind is complicated and costly.

Moreover, it is difficult to envisage using a system of the above kind to reproduce anything other than a simple signature, for example a salutation. In particular, the salutation may need to change according to the nature of the letter and this may require a plurality of cams to be produced for the same signature.

The invention solves all the above problems by proposing a motorized pantograph.

SUMMARY OF THE INVENTION

The invention provides a machine for reproducing writing, in particular signatures, including a pantograph carrying a fountain pen or the like and having two branches with respective operating shafts coupled to respective electric rotational drive means, the machine further including control means for the drive means adapted to deliver electrical information representative of predetermined manuscript writing.

The pantograph can have two branches with two articulated members joined together by an articulation near which the fountain pen is attached. The two ends of the two branches are respectively provided with the operating shafts, which are driven by two electric motors. The motors are advantageously stepper motors with open-loop control. The motors can instead be DC motors with their position sensed by an optical encoder or the like or contactless motors controlled the same way.

Each motor is preferably coupled to a corresponding operating shaft of the pantograph by a speed-reducing mechanism. The speed-reducing mechanism can include a lead screw fixed to the shaft of the motor and a gear or toothed sector coupled to the operating shaft. Other speed reducers can be used instead, employing notched belts or gears, for example (this list is not comprehensive). The speed reducers might also be eliminated by using high-torque motors to drive each operating shaft directly.

The control means advantageously include a memory storing information representative of synchronized movements of the two motors. The information stored in this memory is read and decoded in a predetermined order and under the control of a clock to control the movement of the two motors and consequently of the fountain pen at the end of the pantograph. The memory therefore and advantageously replaces the cam system used previously. The memory can be a preprogrammed read-only memory containing information for reproducing a signature and an accompanying salutation, for example. The use of a read-only memory is advantageous in that it can be incorporated into a removable module that can easily be replaced by another similar module containing information representative of other predetermined writing, namely another signature and/or another salutation. The memory also contains information for commanding raising of the pantograph so that the fountain pen is not always in contact with the sheet of paper, should this be necessary for the required reproduction.

According to another advantageous feature of the invention the pantograph includes a lifting lever consisting of a plurality of articulated members controlled by an electric actuator such as an electric motor or an electromagnet and an associated cam. The cam actuates the lever, which is attached to the aforementioned two branches of the pantograph, preferably at the articulation between the two branches.

The invention will be better understood and other advantages of the invention will become more clearly apparent in the light of the following description of a machine in accordance with the invention for reproducing writing, which description is given by way of example only and with reference to the accompanying drawings.

DETAILED DESCRIPTION OF THE PREFERRED EMBODIMENT

Figure 1:
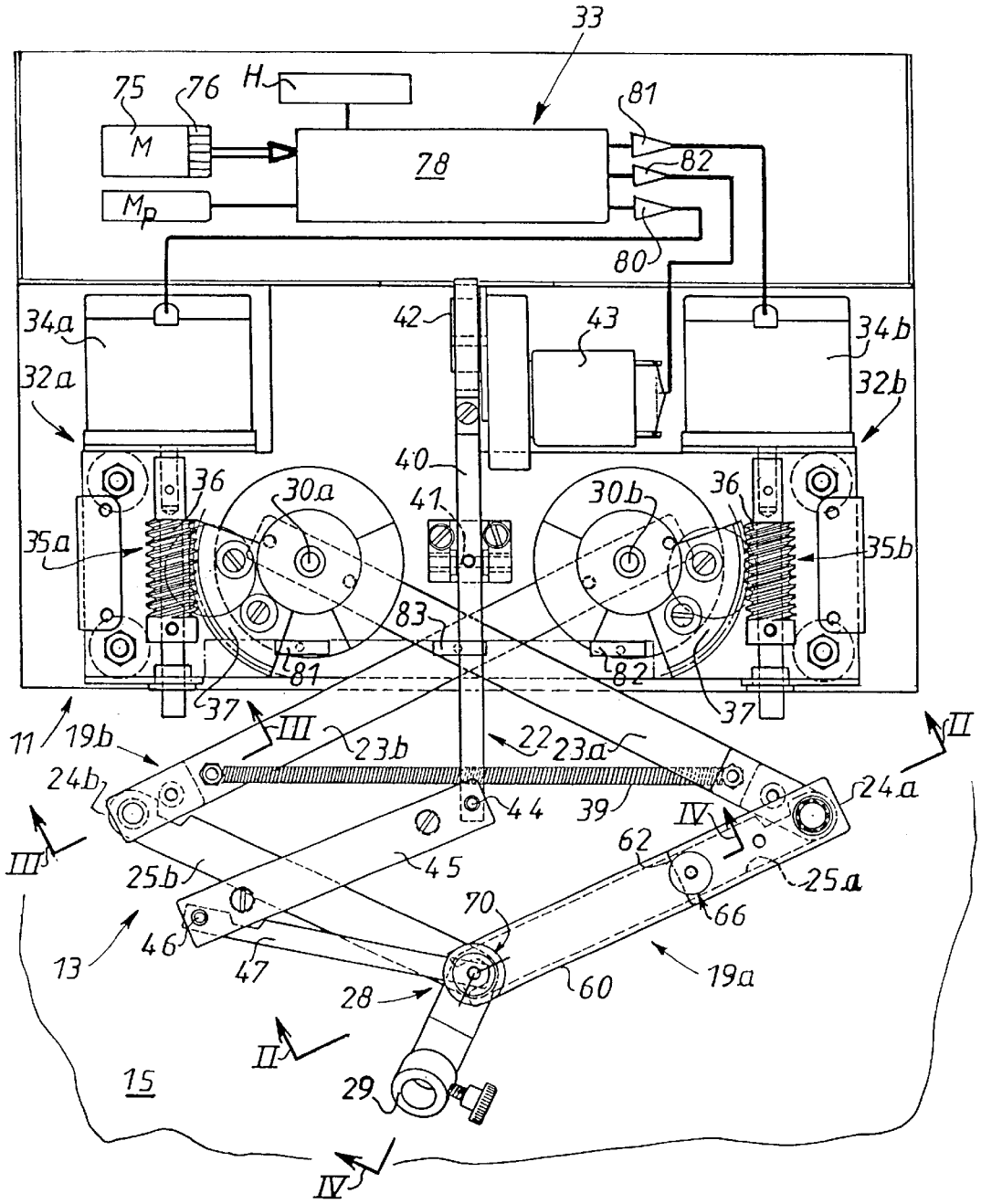
FIG. 1 is a general view of the machine showing its mechanical components from above and its electronic components in the form of a block diagram.

The machine 11 for reproducing writing shown in the drawings includes a pantograph 13 carrying a fountain pen 14. The pantograph moves over a plane surface 15 on which a sheet of paper 16 can be placed. Conventional cut-sheet handling means can be used to feed successive documents to be written on onto this surface. These mechanisms do not form part of the invention and for this reason are not described in detail here.

The pantograph shown here has two branches 19*a*, 19*b* and a lifting lever 22. Each branch includes two rectilinear members articulated end-to-end. Thus the branch 19*a* includes a first member 23*a* connected by an articulation 24*a* to a second member 25*a* which carries at its other end a support 29 adapted to receive the fountain pen 14. The other branch includes a first member 23*b* similar to the member 23*a* of the branch 19*a* and a second member 25*b* connected to the first member 23*b* by an articulation 24*b*. The other end of the second member 25*b* is connected to the second member 25*a* of the branch 19*a* by an articulation 28 near the fountain pen support 29. Thus the two branches 19*a*, 19*b* are joined together by the articulation 28 which is near the fountain pen 14. Each branch also has an operating shaft 30*a*, 30*b*, to be more precise a shaft perpendicular to the corresponding branch and attached to the end of the first member 23*a* or 23*b* opposite the articulation 24*a* or 24*b*. The operating shafts are connected to respective separate electric rotation drive means 32*a*, 32*b*. The machine is completed by control means 33 for the drive means which are adapted to deliver electrical information representative of a predetermined manuscript writing. To be more precise, the drive means include two electric motors 34*a*, 34*b* mechanically coupled to the respective operating shafts 30*a*, 30*b* via corresponding speedreducing mechanisms 35*a*, 35*b*. A speed-reducing mechanism comprises a lead screw 36 fixed to the end of the motor shaft and a toothed sector 37 fastened to the operating shaft.

The rotation axis of the toothed sector coincides with the aforementioned operating shaft. The two motors are advantageously stepper motors which have the advantage that their position and movement can be controlled with great accuracy in both directions by an open loop system.

A prestressed tension spring 39 links the members 23*a*, 23*b* to take up any slack.

The lifting lever 22 includes a plurality of rectilinear members articulated end-to-end. The member 40 is mounted on a pivot 41 so that it can turn in a plane perpendicular to the plane surface 15 on which the sheet of paper rests. One end is in contact with a cam 42 driven by a motor 43. The motor rotates through one half-turn each time it receives a control pulse, the effect of which is to place the cam in one or the other of two positions and consequently to turn the member 40 toward one or the other of two positions. The other end of this member is connected by an articulation 44 to a second rectilinear member 45 in turn connected by an articulation 46 to a third rectilinear member 47. The opposite end of the latter is attached to the two branches 19*a*, 19*b* of the pantograph at the point where the two members 25*a*, 25*b* join, near the fountain pen support 29. The purpose of this arrangement is to support the branches of the pantograph and consequently the fountain pen, holding the latter at a particular height above the plane surface when it is not writing and allowing it to rest on the plane surface, and consequently on the surface of the paper, when it is writing. The articulations 44 and 46 include journals perpendicular to the members 40, 45 and 47 constituting the lifting lever 22.

Figure 2:
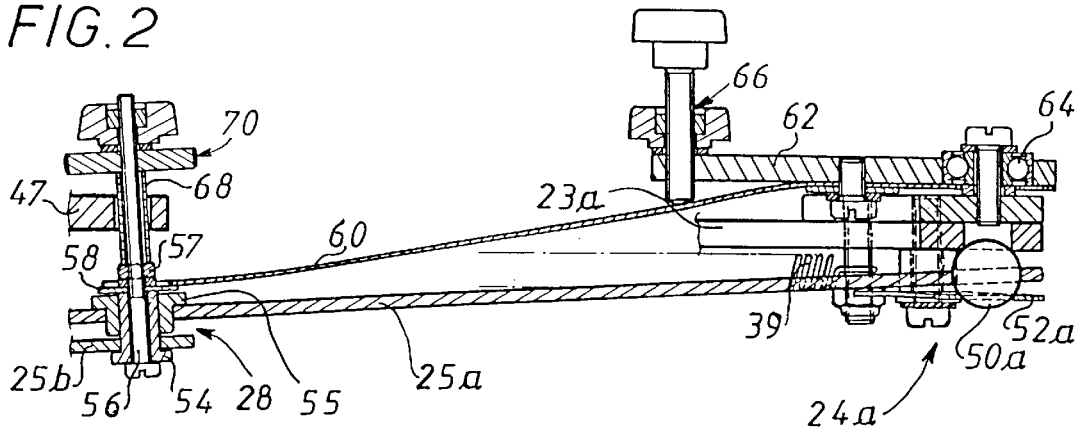
FIG. 2 is a view in section taken along the line II—II in FIG. 1 with the pantograph in an operating position.
Figure 3:
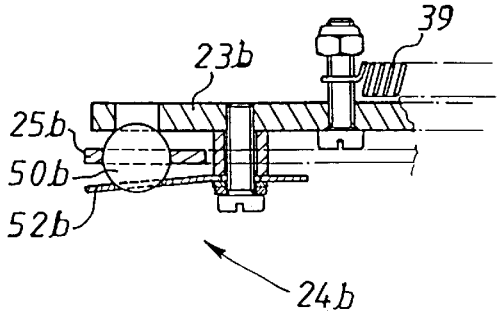
FIG. 3 is a view in section taken along the line III—III in FIG. 1.
Figure 4:
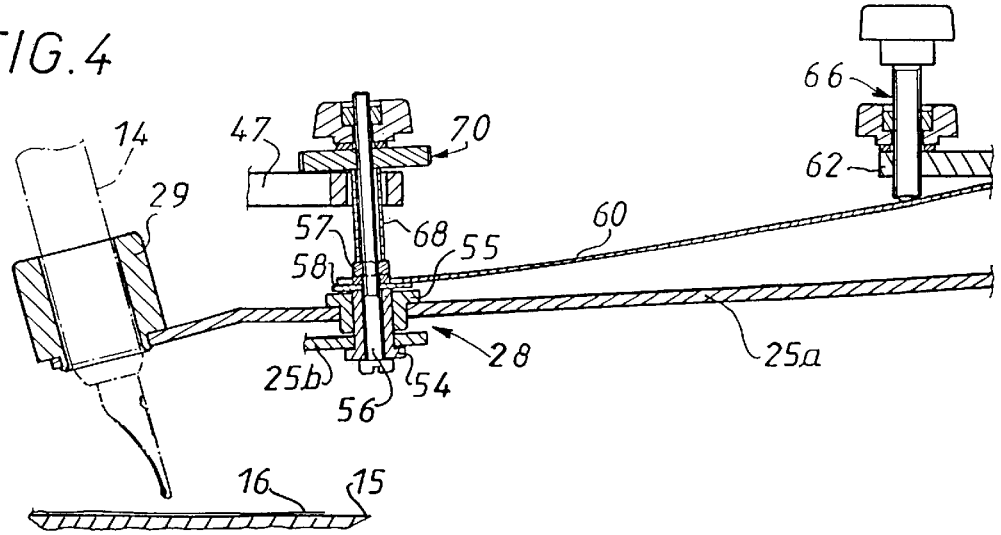
FIG. 4 is a view in section taken along the line IV—IV in FIG. 1 and shows the fountain pen raised.

FIGS. 2 to 4 show more clearly the structure of the branches, the articulations between their members, their attachment and how they are joined onto the lifting lever 22. The articulation 24*a* which joins the members 23*a* and 25*a* is a ball joint. The ball 50*a* is retained in a hole passing through the member 25*a* and is partly engaged in a smaller hole in the member 23*a*. It is pressed against the perimeter of this latter hole by a leaf spring 52*a* fixed to a column attached to the member 23*a*. The spring has a hole in it in which the ball 52*a* is partially engaged. The articulation 24*b* which joins the members 23*b* and 25*b* has the same structure. It is therefore a ball joint in which the ball 50*b* is retained in a hole through the member 25*b* and partly engaged in a smaller hole in the member 23*b*. It is pressed against the perimeter of this latter hole by a leaf spring 52*b* fixed to a column attached to the member 23*b*. The spring has a hole in it in which the ball is partly engaged. The members 25*a* and 25*b* are joined at the articulation 28 which consists of two coaxial, shouldered, tubular, sliding rings 54, 55. The rings are different diameters and fit one within the other. The larger diameter ring 55 is mounted in a hole in the member 25*a* and the smaller diameter ring 54 is mounted in a hole in the member 25*b*. The two rings are assembled together by a screw 56 passing axially through the ring 54 and projecting upward. A nut 57 and a washer 58 fix the two rings together around the screw. A leaf spring 60 is mounted between a support 62 and the articulation 28. The spring 62 is mounted on the member 23*a* by means of a small ball bearing 64. The spring terminates at the articulation 28 end in a fork which bears on the washer 58. The force applied by the spring to the articulation 28 (and therefore urging the fountain pen towards the sheet of paper) is adjusted by a screw-in knob 66 mounted on the support 62 and whose end bears on the spring.

The top of the mounting screw 56 is surrounded by an electrically insulative material sleeve 68. On top of this sleeve is a metal nut 70 which is screwed onto the screw 56 and forms an electrical contact abutment whose position can be adjusted. The end of the lifting lever member 47 incorporates a hole by means of which it is attached to the articulation 28. To be more precise, the screw 56 and the sleeve 68 pass through this hole; sufficient annular clearance is provided to enable the lever to occupy two positions relative to the pantograph. The members of the lever and those of the pantograph are made from electrically conductive materials (typically metal), except for the sleeve 68. The pantograph is electrically insulated from the remainder of the machine so that electrical contact between said lever and said pantograph is made or not, depending on the position of the lever 22. Thus in the configuration shown in FIG. 2 the fountain pen (not shown) is in contact with the sheet of paper and the member 47 occupies an intermediate position along the insulative sleeve. No electrical contact is made between the lever and the pantograph. In FIG. 4, on the other hand, when the lever 22 is in the raised position to lift the fountain pen, electrical contact is made between the member 47 and the nut 70. This electrical contact is therefore representative of lifting of the fountain pen and is used to indicate this. When the lever lowers the pantograph to place the fountain pen in contact with the paper, the electrical contact disappears at the moment the fountain pen touches the paper, which enables movement or resumption of movement of the pantograph to be synchronized with actual contact of the fountain pen with the paper. This is described in more detail later.

Because of the successive articulations 44, 46 along the lifting lever, the end of the member 47 has no effect on the pantograph other than lifting the fountain pen under certain circumstances. In particular, when the machine is on standby, the pantograph places the fountain pen in a predetermined position facing the plane surface and the lifting lever holds the fountain pen above the plane surface, with no contact with the paper. At the end of each writing operation, a reset procedure repositions the pantograph in this predetermined position after raising the fountain pen 14. To this end, the motors are driven in accordance with a particular program until an optical or mechanical abutment is reached, indicating that the pantograph is in position for a further writing operation.

In the example shown, the control means 33 include a memory M in which is stored information representative of synchronized movements of the two motors 34*a*, 34*b* and information representative of the actuation of the motor 43.

The memory M is advantageously a preprogrammed read-only memory. Here it is part of a removable module 75 which can be connected to the other circuits of the control means 33 via an appropriate connector 76. Thus a particular module 75 containing information representative of a particular signature, possibly accompanied by a handwritten message, can quickly and at any time be replaced by another similar module containing information representative of another predetermined writing, for example another signature and/or another handwritten salutation.

The control means 33 include reading and decoding means connected to the memory M and here symbolized by a processor 78 with an associated program memory Mp, which reads and decodes the information stored in the read-only memory in a predetermined order and under the control of a clock H. The processor delivers three control signals which are applied to respective inputs of three amplifiers 80, 81, 82 whose respective outputs are connected to the motors 34*a*, 34*b* and 43.

When stepper motors are used (and a half-turn motor for operating the lifting lever), the signals delivered by the processor to the various amplifiers are simple positive or negative pulses occurring at predetermined times relative to each other as the content of the readonly memory M is read under the control of the clock H. These pulses cause the end of the pantograph carrying the fountain pen to move to reproduce the required salutation and/or signature.

Each time that the processor 78 generates an instruction to raise the fountain pen, according to the information contained in the memory M, the motor 43 is operated, the fountain pen is raised and at the same time electrical contact is made between the member 47 and the nut 70. This electrical contact is acted on by the processor which "monitors" it while the pantograph is moving the fountain pen to a new position to resume writing. That position is read in the memory M, for example. The motor 43 is then operated again to lower the lever, but the processor does not resume reading the information contained in the memory M under the control of the clock H until the electrical contact disappears, indicating that the fountain pen is in contact with the paper.

Optical sensors 81, 82, 83 facing respective detectable portions of the sectors 37 and the lever 40 monitor the positions of the branches of the pantograph and the lever.

A read-only memory integrated into the module 75 which can be fitted to the connector 76 can be programmed in the following manner. A pantograph identical in all respects to that which has just been described but having no drive means is used. In other words, the operating shafts 30*a*, 30*b* are connected to high-resolution optical encoders instead of motors. A digital electronic system stores the output signals from the two encoders. These are, for each encoder, two squarewave signals with a relative phase difference of 90° indicating displacement in terms of amplitude, speed and rotation direction. Encoding means translate this information into digital data. This information is stored in a random access memory addressed by a counter controlled by a clock at the same frequency as the clock used in the device described above. A module containing a programmable read-only memory is then connected to the data input device and the information is transferred from the random access memory to the read-only memory, which is then ready to be used.

A system can be used instead that employs a scanner to digitize the writing and position it in a space corresponding to the dimensions of the pantograph. The writing is scanned point by point and converted into digital data that is stored and then transferred in the same manner to a read-only memory. If the read-only memory is not removable, a reprogrammable read-only memory can be used.

Other variants are feasible. For example, the machine can be simplified. The lifting lever can be dispensed with if the whole of the chassis is mobile and able to turn about an axis passing substantially through the center of gravity of the device. It is then the device as a whole which pivots to raise or lower the fountain pen.

Similarly, the lever can be dispensed with if the support 29 includes means for raising and lowering the fountain pen relative to the two branches of the pantograph. A sliding device or "lift" can be mounted at the end of the pantograph and actuated by a small electric motor with appropriate speed reduction to raise and lower the fountain pen.

In another variant, a long swing-arm can bear on the bottom of the members 25*a*, 25*b* of the pantograph, the arm having at its end a perpendicular rigid rod of sufficient length to match the average movement of a pantograph. It suffices to move the other end of the arm by means of an electric motor driving a cam, a screw or any other system for converting rotary movement into rectilinear movement. By this means the pantograph can be raised at any time regardless of the location of the fountain pen.

There is claimed:

1. A machine for reproducing writing, in particular signatures, including a pantograph carrying a writing instrument, the movements of which are controlled by two branches with respective operating shafts directly coupled to respective electric motor means, said machine further including control means comprising respective outputs connected to the respective electric motor means, said control means producing two electrical signals, one to each of the electric motor means, representative of predetermined manuscript writing.

2. The machine claimed in claim 1 wherein said pantograph has two branches with two articulated members joined together by an articulation near which said waiting instrument is attached and two ends of said two branches are respectively provided with said operating shafts.

3. The machine claimed in claim 2 wherein said electric motors means are stepper motors.

4. The machine claimed in claim 2 wherein each of said electric motor means is coupled to an operating shaft by a speed-reducing mechanism.

5. The machine claimed in claim 4 wherein said speed-reducing mechanism includes a lead screw fixed to the shaft of said electric motor means and a gear or toothed sector coupled to said operating shaft.

6. The machine claimed in claim 2 wherein said control means includes a memory storing information representative of synchronized movements of said two electric motor means.

7. The machine claimed in claim 6 wherein said memory is a preprogrammed read-only memory.

8. The machine claimed in claim 7 wherein said read-only memory is part of a removable module which can be replaced by another similar module containing information representative of other predetermined writing.

9. The machine claimed in claim 6 wherein said control means include means for reading and decoding information stored in said memory in a predetermined order and under the control of a clock.

10. The machine claimed in claim 6 wherein said pantograph includes a lifting lever consisting of a plurality of articulated members controlled by an electric actuator and one end of said lever is attached to the aforementioned two branches.

11. The machine claimed in claim 10 wherein said lever is attached to the articulation between said two branches.

12. The machine claimed in claim 11 wherein said memory also contains information representative of the state of said lifting lever.

13. The machine claimed in claim 10 wherein said memory also contains information representative of the state of said lifting lever.

14. The machine claimed in claim 10 wherein said lifting lever and said pantograph are adapted to make electrical contact between them representative of raising of said writing instrument and used as an indication thereof.

15. The machine claimed in claim 14 wherein the end of said lever attached to said pantograph is engaged over an insulative material sleeve and cooperates with an electrical contact abutment carried by said pantograph and at least one member of said pantograph is urged toward a plane surface on which a sheet of paper can be placed.

16. The machine claimed in claim 2 wherein each branch of said pantograph includes two members connected together by a ball joint.

* * * * *